United States Patent [19]

Schneider

[11] Patent Number: 4,697,699

[45] Date of Patent: Oct. 6, 1987

[54] SHIPPING CONTAINER

[75] Inventor: Wesley C. Schneider, Chicago, Ill.

[73] Assignee: Tootsie Roll Industries, Inc., Chicago, Ill.

[21] Appl. No.: 795,512

[22] Filed: Nov. 6, 1985

[51] Int. Cl.[4] ..... B65D 77/24; B65D 90/04

[52] U.S. Cl. ..... 206/44.11; 108/51.3; 108/56.1; 206/44 R; 206/599; 206/600; 229/23 A; 229/23 R

[58] Field of Search ..... 206/386, 595–600, 206/44 R, 45.31, 45.34, 44.11; 229/15, 23 R, 23 A, 27, 28 R, 162; 108/51.3, 55.1, 55.3, 55.5, 56.1, 56.3; 53/201, 475

[56] References Cited

U.S. PATENT DOCUMENTS

| | | | |
|---|---|---|---|
| 2,065,150 | 12/1936 | O'Brien | 229/15 |
| 2,098,639 | 11/1937 | Walther | 229/27 |
| 2,534,010 | 12/1950 | Frye | 206/597 |
| 2,534,011 | 12/1950 | Frye | 206/597 |
| 2,659,483 | 11/1953 | Paige et al. | 206/44 R |
| 3,052,397 | 9/1962 | Budd | 206/599 |
| 3,229,889 | 1/1966 | Vrana | 229/28 R |
| 3,746,242 | 7/1973 | Troth | 206/45.34 |
| 4,165,806 | 8/1979 | Cayton | 206/386 |
| 4,230,227 | 10/1980 | Kowall et al. | 206/600 |
| 4,324,333 | 4/1982 | Porter | 206/386 |
| 4,342,417 | 8/1982 | Forbes, Jr. | 206/15 |
| 4,354,596 | 10/1982 | Lavery | 206/45.34 |

FOREIGN PATENT DOCUMENTS

| | | | |
|---|---|---|---|
| 2316150 | 10/1974 | Fed. Rep. of Germany | 229/28 |

*Primary Examiner*—Stephen Marcus
*Assistant Examiner*—Jimmy G. Foster
*Attorney, Agent, or Firm*—Wolf, Greenfield & Sacks

[57] ABSTRACT

A container for shipping and display of items within the container which consists of a rectangular box of sheet material having a sleeve with an open upper and lower end forming four side walls. A bottom having a lip receives the sleeve. Individual containers are positioned within the lower half of the larger container and are separated from the upper which is filled with a plurality of small articles. A cover and a brace designed to replace the cartons are also provided.

3 Claims, 7 Drawing Figures

SHIPPING CONTAINER

SUBJECT MATTER OF INVENTION

The present invention relates to an improved combination, shipping and display container for small commercial products such as candy and the like.

BACKGROUND OF THE INVENTION

The expense of shipping and displaying small retail products that are normally sold in supermarkets, drugstores and similar retail operations, are a significant part of the overall cost of merchandising such products. For that reason, there is an ever present need to provide improved means for shipping and displaying products such as food stuffs including, specifically, candy. Heretofor, cartons have been designed for both shipping and display purposes. Insofar as known, however, these cartons have a variety of limitations which affect their function for either shipping, or display, or both. For example, shipping cartons which consists essentially of rectangular paper board cartons having a selective arrangement of dividers within the container to be reassembled after shipment for display with a sign associated with it have been known for some time. Some of these cartons are complicated to manufacture and, consequently, are costly, while others are not sufficiently sturdy to support and contain significant weight during shipment. Others have significant limitations which inhibit use on pallets and limit the ability to properly handle the containers in shipment.

SUMMARY OF INVENTION

The present invention provides an improved carton that is useful for both shipping and displaying a variety of small components such as small articles of food stuffs, including candy.

The present invention provides a relatively inexpensive container having improved structural features that is sufficiently sturdy to support and contain considerable weight.

Another feature of the present invention provides an improved means for separately storing a multiple variety of components for easy display and handling at a retail location.

A further object and advantage of the present invention provides improved supports for the container which supports function as legs that also raise the container above the floor level to improve its use as a display for retail consumables such as candy.

In the present invention, a container for shipping and displaying small items comprises a rectangular box of sheet material having a sleeve forming four side walls. The sleeve fits into a separable bottom which also receives a plurality of boxes that enclose the lower half of the sleeve when the box is shipped. Means are also provided to support the boxes in the upper half of the sleeve when the box is used for display.

BRIEF DESCRIPTION OF DRAWINGS

The foregoing objects and advantages of the present invention will be more clearly understood from a consideration of a preferred embodiment of the invention, as illustrated in the accompanying drawings, in which.

DETAILED DESCRIPTION OF DRAWINGS

Figure 2:
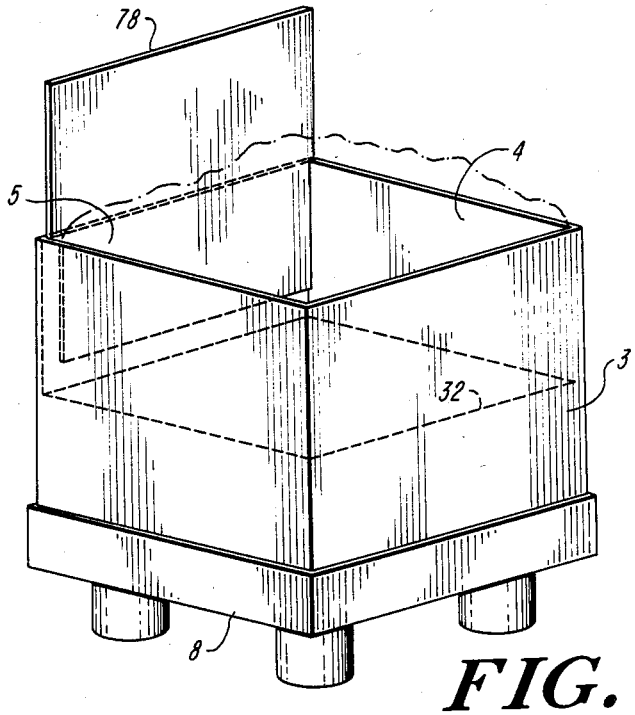
FIG. 2 is a perspective view similar to that of FIG. 1 with the carton in display position.
Figure 3:
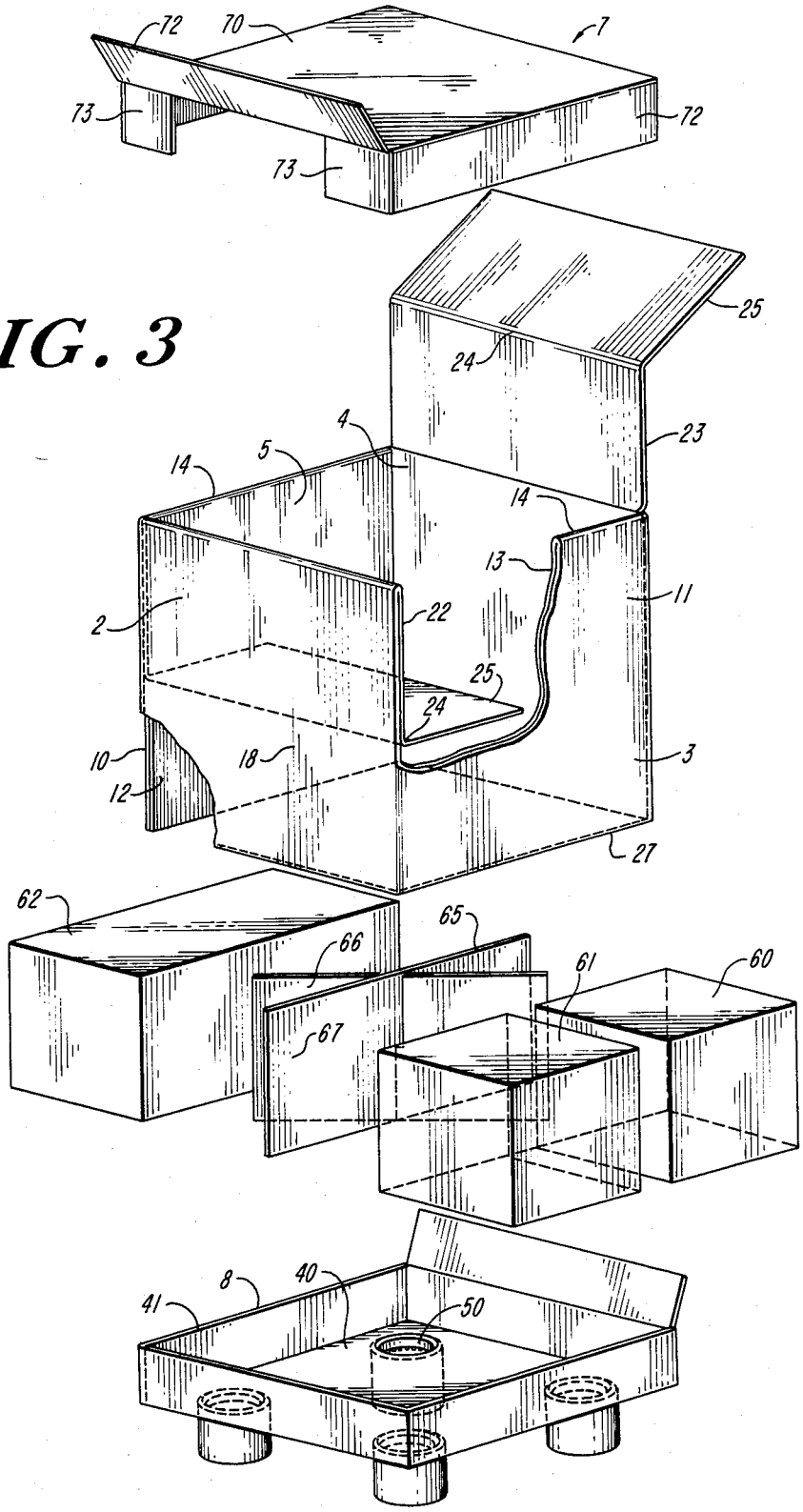
FIG. 3 is an exploded view of the carton.

The container 1 is formed as a rectangular box having rectangular side walls 2, 3, 4 and 5, a separate cover 7 and bottom 8. The rectangular side walls are preferably formed as illustrated in FIG. 3. The side walls 2, 3, 4, and 5 are preferably formed as a sleeve with a single piece of material that is open at either end. Side walls 3 and 5 are formed of double thickness. Side wall 3 has an inner portion 13 and an outer portion 11, integral along the upper edge 14, while side wall 5 is formed with inner portion 12 and outer portion 10, also integral along upper edge 14. The portions 10–12 and 11–13 are, preferably, coextensive. Side walls 2 and 4 are formed with outer portions 18, as illustrated in FIG. 3. These outer portions 18 are integrally formed with inner portions 22 and 23. The inner portions 22 and 23 are folded transversely along lines 24 so that the lower half 25 of the inner portions 22 and 23 may be folded at right angles to the side walls 2 and 4 to form a platform half way between the upper edge 14 and lower edge 27 of the side walls 2 and 4. The inner portion 23, as illustrated in FIG. 3, has been articulated upwardly for illustrative purposes only. However, the lower portions 25 of the inner walls assume the position illustrated by the dotted line 32 in FIG. 2. The side walls engage the bottom 8, as best illustrated in FIG. 3–5.

Figure 4:
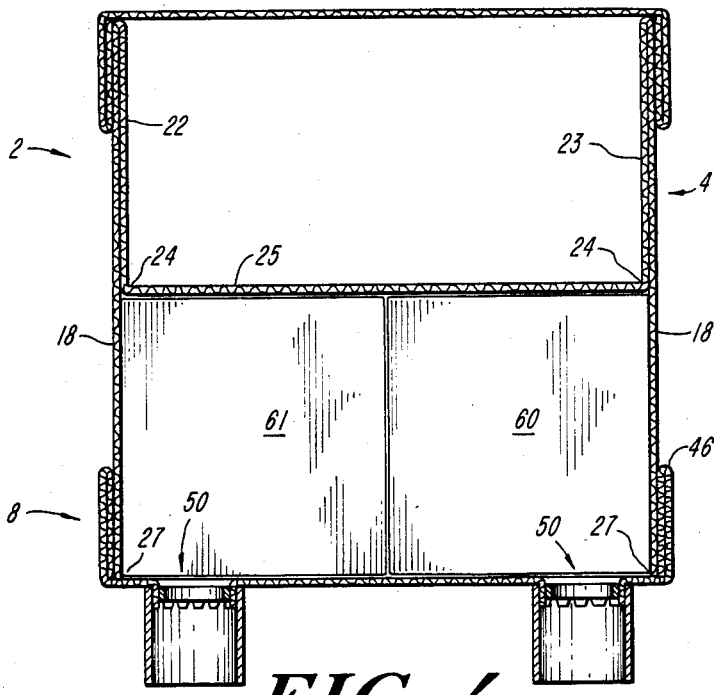
FIG. 4 is a cross-sectional view taken along the line 4—4 of FIG. 1.
Figure 5:
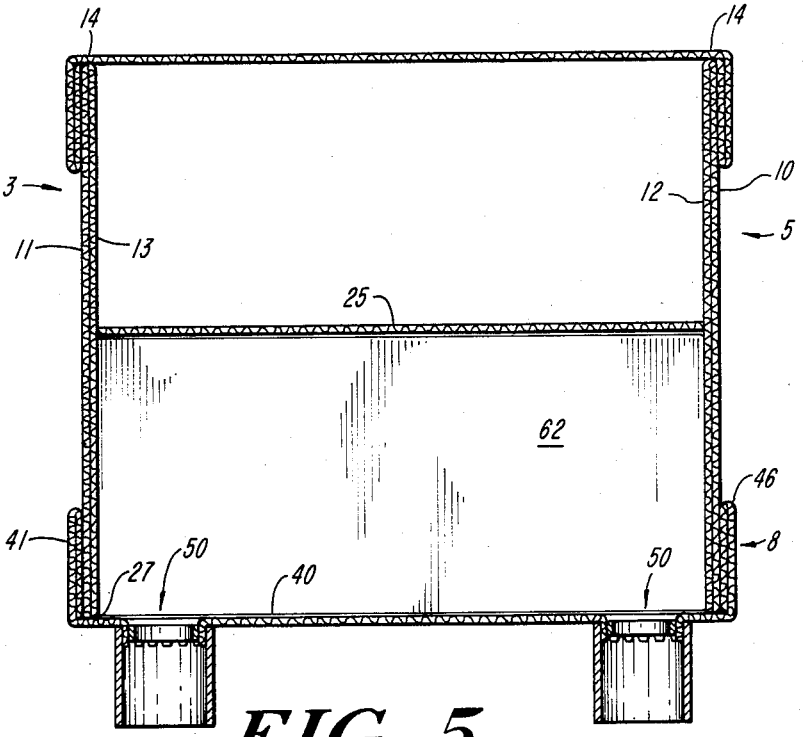
FIG. 5 is a cross-sectional view taken along the line 5—5 of FIG. 1.

The bottom 8 is formed with a bottom sheet 40 having an upwardly extending peripheral lip 41 (FIG. 4 and 5). The lower edge 27 of the side walls rests on the bottom sheet 40 with the outer surface of the side walls 2, 3, 4 and 5 and facing relation with the inner surface of the lip 41. The bottom 8 may be formed of a single sheet of material 40 with the periphery folded upwardly in a double thickness, as illustrated in FIGS. 4 and 5 at 46, in order to provide additional strength to the overall construction.

Figure 6:
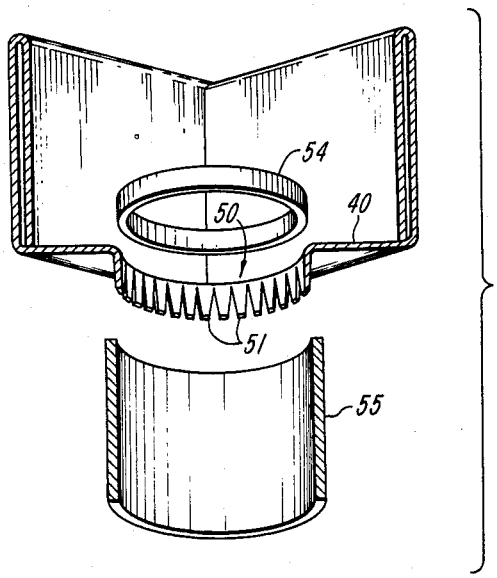
FIG. 6 is an exploded fragmentary perspective view of the detail of the invention.
Figure 7:
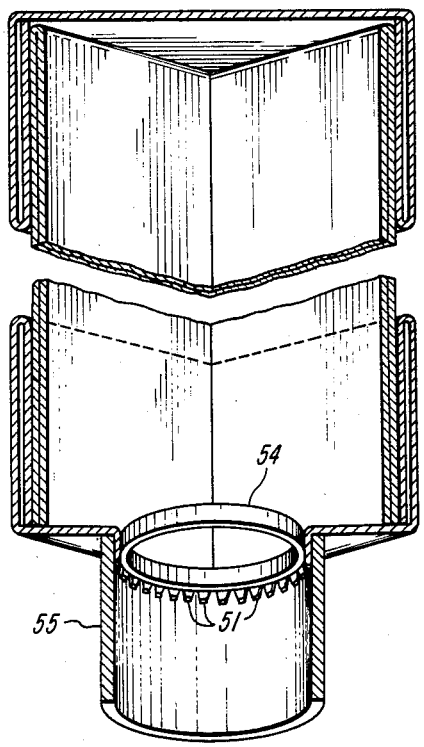
FIG. 7 is a fragmentary perspective view of a corner of the container including an assembled leg construction.

Four holes 50 are formed in the bottom sheet 40 at each corner of the bottom 8. These holes are formed with depending tabs 51 (FIG. 6 and 7) arranged in a cylindrical array, as illustrated in 51. Each of these tabs may be formed simultaneously by die-cutting the holes 50 from the bottom sheet 40. The tabs 51 are folded downwardly at an angle normal to the plane of the sheet 40. Inner and outer rings 54 and 55 are force fit respectively on the inner and outer surfaces of the downwardly turned tabs 51. Inner ring 54 has a height that is about the same as the height of tabs 51 and may be of about the same thickness as the thickness of tabs 51. The annular outer surface of ring 54 engages the inner surface of tabs 51 in a force fit, while the upper periphery of the inner surface of outer ring 55 engages the outer surfaces of the tabs 51 in a force fit. In assembly, the outer ring 55 may first be placed about the tabs 51 and thereafter the inner ring forced downwardly to secure the assembly in a sandwich like configuration. The outer ring 55 should be made of sturdy and heavy cardboard. The height of rings 55 may vary, but preferably is in the order of 6".

Individual containers of products, such as candy, may be packed in individual cartons such as cartons 60, 61 and 62 that are themselves designed and shaped to fit snugly within the side walls of the container 1 below the lower half 25 of inner portions 22 and 23. Additionally, a divider 65 formed of interlocking rigid sheets 66 and 67, conventionally scored and interlocked, may also be suitably stored below the lower walls 25 in a non interlocked position. Preferably, the cartons 60, 61 and 62 are closely fitted with the divider 65 lying flat against carton 60 to form a tight and compact fit.

The cover 7 may be conventionally formed, as illustrated in FIG. 3, with a top sheet 70 having downwardly turned flaps forming side walls 72 that are suitably cemented or secured together as, for example, by tabs of flaps 73 in a conventional fashion.

Figure 1:
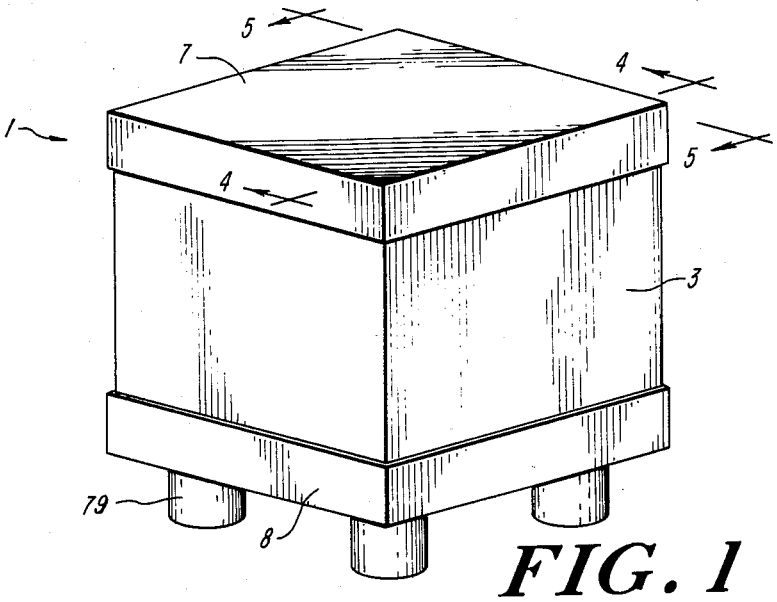
FIG. 1 is a perspective view of a carton embodying the invention in a shipping configuration.

The cover and bottom in the assembled configuration, illustrated in FIG. 1, fit tightly over the upper edge 14 and lower edge 27 of the side walls, as illustrated in FIG. 1. A conventional band, or bands of metal, or other non-yielding material are secured about the cover, bottom and side walls in a conventional fashion to hold the assembly together during shipment. In addition to the goods secured below the bottom flaps 25, the space above the bottom wall 25 may also be filled with goods, or products to completely fill the shipping carton. A display sign may be fitted over the goods in the upper portion of the box. This display sign 78 may be removed after shipment when the products are displayed, as illustrated in FIG. 2, with the cover removed.

The carton, as illustrated, provides a strong container for shipping heavy goods in bulk. Thus, for example, a carton, as illustrated, having dimensions of approximately 2 feet on a side may be filled with between 150 and 200 pounds of candy which can be shipped by conventional, commercial shipping means without likelihood of damage. When shipped the full cartons 60, 61 and 62 are filled with product and are separated from the upper half of the box by divider 25. The upper half of the carton is also filled with product during shipping. The carton, as illustrated, may then be used to display the goods, as best illustrated in FIG. 2. In such an arrangement goods located in the upper half of the container are first sold. After those goods have been sold or removed, the sleeve, consisting of the side walls 2, 3, 4 and 5, may be lifted from the bottom 8 and the individual container 60, 61 and 62 removed. The divider 65 is then set up and placed in the bottom 8 in a cross-bracing position and the sleeve returned to its original position. The goods in the cartons 60, 61 and 62 may then be emptied into the upper carton or, if desired, may be displayed within the cartons 60, 61 and 62 after those cartons have been placed in the upper half of the container 1. Since the container is provided with four legs 79, the unit is raised above the floor level. Raising the carton above the floor level improves the appearance of the carton as a display container and, in addition, minimizes the likelihood of damage to the carton or its contents from fluid or other foreign materials which might be on the floor. The structure also permits easier handling of the carton because it provides a space below the container which assists in inserting lifting devices below the container.

Having now described my invention I claim:

1. A container for shipping of items and for display of items within the container at a convenient level for retail sale comprising:

a rectangular box of sheet material defining a sleeve having an open upper end, an open lower end and four sidewalls;

a cover fitting over said open upper end for use during shipping;

a bottom comprising a bottom sheet with a peripheral upwardly extending lip in facing relation to and enclosing said four sidewalls, and legs for raising the level of said container;

means separating the sleeve into an upper section for shipping of cartons and for display of items at a convenient level for retail sale, and a lower section for shipping of cartons, said separating means comprising rigid sheet portions integrally formed with and extending from the upper ends of opposite sidewalls, said rigid sheet portions extending from the upper end of opposite sidewalls, said rigid sheet portions extending downwardly within said sleeve, the lower part of said rigid sheet portions having integral flaps extending from the opposite sidewalls across said sleeve to define said upper and lower sections; and bracing means for supporting said flaps and for dividing said lower section into subsections for receiving cartons.

2. A container as set forth in claim 1 wherein said bottom sheet has a plurality of holes formed therein, with each of said holes having a plurality of tabs integral with the bottom sheet and extending from the edge of the hole, and coaxially arranged inner and outer rings with said tabs extending normally from the plane of said bottom sheet and wedged between said inner and outer rings.

3. A container as set forth in claim 1 wherein said bracing means comprises a pair of interlocked rigid sheets.

* * * * *